US007853383B2

(12) United States Patent
Congdon et al.

(10) Patent No.: US 7,853,383 B2
(45) Date of Patent: Dec. 14, 2010

(54) SYSTEM FOR AUTOMATICALLY LOADING A SCRAPER

(75) Inventors: Thomas M. Congdon, Dunlap, IL (US); R. Paul Knight, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 856 days.

(21) Appl. No.: 11/646,545

(22) Filed: Dec. 28, 2006

(65) Prior Publication Data

US 2008/0155866 A1 Jul. 3, 2008

(51) Int. Cl.
*G06F 19/00* (2006.01)

(52) U.S. Cl. ..... 701/50

(58) Field of Classification Search ..... 701/50; 37/411, 403, 407

See application file for complete search history.

(56) References Cited

U.S. PATENT DOCUMENTS

| | | | | |
|---|---|---|---|---|
| 3,978,597 | A | 9/1976 | Brudnak, Jr. | |
| 4,282,933 | A | 8/1981 | Suganami et al. | |
| 4,534,707 | A * | 8/1985 | Mitchell | 417/34 |
| 4,658,908 | A * | 4/1987 | Hannukainen | 172/10 |
| 5,485,885 | A | 1/1996 | Matsushita et al. | |
| 5,535,830 | A | 7/1996 | Matsushita et al. | |
| 5,555,942 | A | 9/1996 | Matsushita et al. | |
| 5,564,507 | A | 10/1996 | Matsushita et al. | |
| 5,694,317 | A | 12/1997 | Nakagami et al. | |
| 6,125,561 | A | 10/2000 | Shull | |
| 6,336,068 | B1 | 1/2002 | Lawson et al. | |
| 6,845,311 | B1 | 1/2005 | Stratton et al. | |
| 6,920,387 | B2 * | 7/2005 | Landes et al. | 701/102 |
| 2006/0070746 | A1 | 4/2006 | Lumpkins et al. | |

OTHER PUBLICATIONS http://salesmanual.deere.com, accessed on Oct. 10, 2006, 3 pages.
U.S. Appl. No. 11/238,933, filed Sep. 29, 2005.

* cited by examiner

*Primary Examiner*—Yonel Beaulieu
(74) *Attorney, Agent, or Firm*—Finnegan, Henderson, Farabow, Garrett & Dunner LLC

(57) ABSTRACT

A system is disclosed for automatically loading a scraper including a method for controlling an implement. The method includes receiving a first signal indicative of a speed of a driven component of the at least one traction device. The method also includes receiving a second signal indicative of a speed of the machine with respect to a surface. The method also includes receiving a third signal indicative of a desired slip of the machine with respect to the surface. The method also includes selectively receiving a fourth signal indicative of an operators desire to affect manual control of the implement. The method further includes determining a first parameter as a function of the received first, second, third, and selectively received fourth signals and controlling the implement as a function of the first parameter.

14 Claims, 2 Drawing Sheets

SYSTEM FOR AUTOMATICALLY LOADING A SCRAPER

TECHNICAL FIELD

The present disclosure relates to a system for loading a scraper and, more particularly, to a method and apparatus for automatically loading a scraper.

BACKGROUND

Machines, such as, scrapers, typically include a tractor connected to a bowl having a blade configured to separate material from a surface of terrain over which the scraper traverses. Both the tractor and the bowl are usually supported on the surface via respective traction devices and an operator usually controls the direction and speed at which the scraper traverses the surface. The blade is typically located in the forward position of the bowl and adjacent the surface, and an operator usually controls the position of the bowl relative to the surface via one or more actuators. By lowering the bowl and driving the tractor over the surface, an operator can engage the blade with the surface of the terrain to dislodge the material and divert the dislodged material into the bowl. After an operator loads the bowl to its full capacity, the operator raises the bowl and transports the material to another location for unloading.

Varying terrain topography, material characteristics, and scraper speed can impact the ability of the scraper to dislodge and load material. Typically, manual control of a scraper with respect to these changing parameters is complicated, requires a significant amount of operator skill, and may be ergonomically difficult, all of which may adversely affect operator safety. Often, an operator adjusts the depth the blade engages and/or penetrates the surface and the speed of the scraper in response to the changing parameters to operate the scraper within a desirable set of conditions, e.g., below an engine torque limit, while speedily loading the bowl.

U.S. Pat. No. 6,125,561 ("the '561 patent") issued to Shull discloses a method for automatic loading of a scraper bowl. The method of the '561 patent includes sensing a force applied to the scraper bowl transmitted thereto via a scraper blade. The method of the '561 patent determines a time dependent error signal as a function of the sensed force and a target force. The method of the '561 patent determines a position command signal as a function of the error signal that is used to automatically adjust the depth of cut of the scraper blade. Additionally, the method of the '561 patent may determine when the scraper bowl is full as a function of the time component associated with the time dependent error signal, a set time limit, and the time when the limit is reached.

Although, the method of the '561 patent may automatically adjust the depth of the cutting blade as a function of target and sensed forces acting on the scraper, considering additional parameters may improve the responsiveness and/or accuracy of the scraper blade control. In addition, the method of the '561 patent is based on controlling the forces transmitted by the scraper blade and determines such forces via hydraulic cylinder pressures which may, however, reduce the accuracy of the determined forces.

The present disclosure is directed to overcoming one or more of the shortcomings set forth above.

SUMMARY OF THE INVENTION

In one aspect, the present disclosure is directed to a method for controlling an implement operatively connected to a machine that has at least one traction device. The method includes receiving a first signal indicative of a speed of a driven component of the at least one traction device. The method also includes receiving a second signal indicative of a speed of the machine with respect to a surface. The method also includes receiving a third signal indicative of a desired slip of the machine with respect to the surface. The method also includes selectively receiving a fourth signal indicative of an operators desire to affect manual control of the implement. The method further includes determining a first parameter as a function of the received first, second, third, and selectively received fourth signals and controlling the implement as a function of the first parameter.

In another aspect, the present disclosure is directed to a system for controlling an implement operatively associated with a scraper bowl that is configured to contain material separated from a surface of material by the implement. The system includes an actuator configured to affect movement of the implement with respect to the surface of material. The system also includes a first operator interface device configured to establish a parameter indicative of an operators desire to affect manual control of the implement and a plurality of sensors. The system further includes a controller configured to selectively receive a first signal indicative of an actuation of the first operator interface device and receive a plurality of signals from the plurality of sensors. The controller is also configured to determine an amount of slip associated with the scraper bowl with respect to the surface of the material as a function of the first signal and the plurality of signals. The controller is also configured to determine a first parameter as a function of at least the first signal and the determined amount of slip and affect control of the actuator as a function of the determined first parameter.

DETAILED DESCRIPTION

Figure 1:
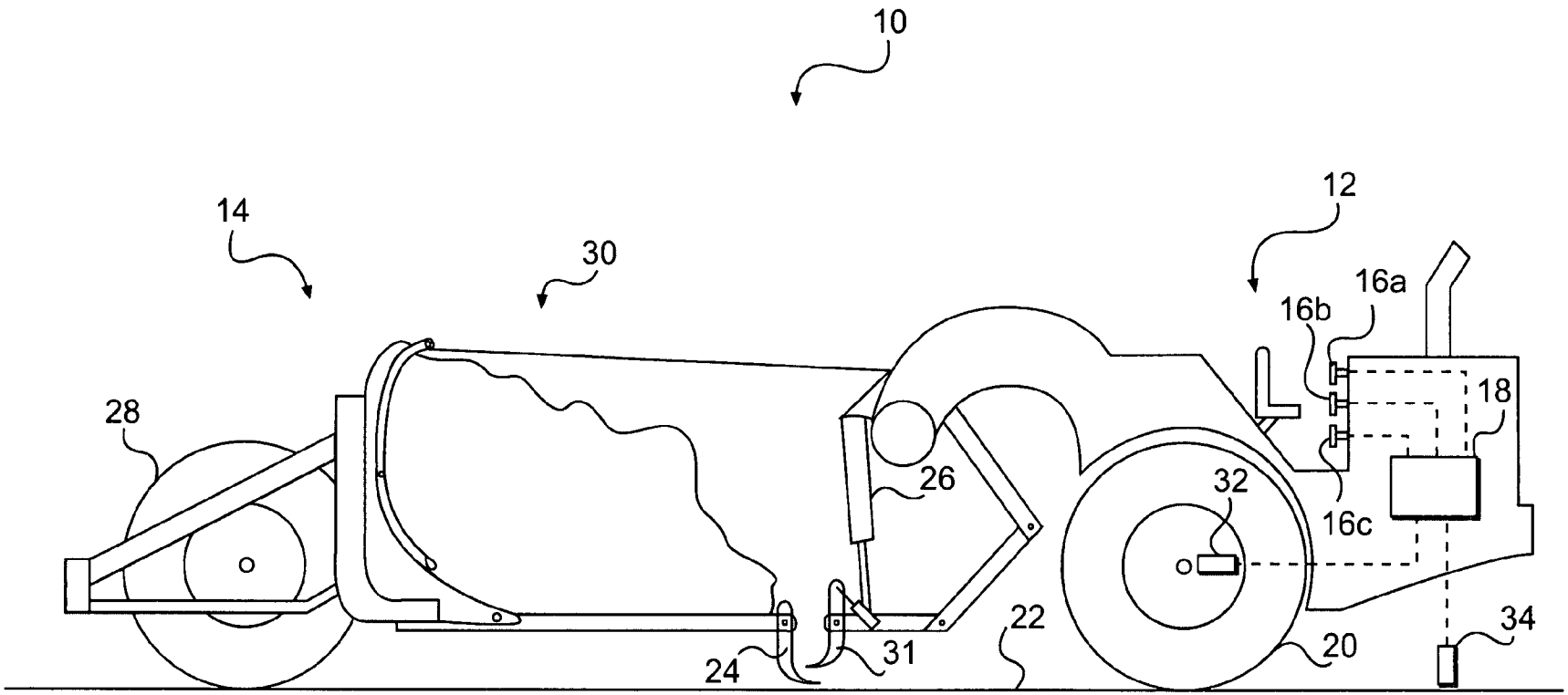
FIG. 1 is a diagrammatic illustration of an exemplary machine in accordance with the present disclosure.

FIG. 1 illustrates an exemplary machine 10. Specifically, machine 10 may include a scraper or other material loading and/or handling machine configured to load material onto the machine, transport the material, and unload the material. For example, machine 10 may include a tractor 12 operatively connected to a bowl 14 and configured to pull bowl 14 across a surface 22 of material. Tractor 12 may include one or more operator interface devices 16*a*, 16*b*, 16*c*, a controller 18, and may be supported relative to surface 22 via one or more traction devices 20 (only one of which is illustrated). Bowl 14 may be configured to dislodge or disrupt material from surface 22, load such material, and contain or store such material, e.g., loaded material 30, therein. For example, bowl 14 may include an implement 24, an actuator 26, an apron 31, and may be supported relative to surface 22 via one or more traction devices 28 (only one of which is illustrated). It is contemplated that machine 10 may include any number of bowls 14 operatively connected to one another and/or to tractor 12 as is known in the art. It is also contemplated that tractor 12 and/or bowl 14 may each include a frame having movable and/or fixed linkages or structural components, any dimensions, and may or may not be pivotal with respect to one another. It is further contemplated that bowl 14 may additionally include an elevator or other conveyor configured to assist in loading the bowl as is known in the art.

Operator interface devices 16*a*, 16*b*, 16*c* may include proportional-type controllers. Specifically, operator interface device 16*a* may include a knob or dial configured to produce a signal indicative of a desired slip of machine 10 with respect to surface 22. Operator interface device 16*a* may allow an operator to adjust the amount of slip of machine 10 with respect to the characteristics of the material associated with surface 22. Additionally, operator interface device 16*b* may include a dial configured to produce a signal indicative of a desired operator aggressiveness with respect to the operation of machine 10. The operation of machine 10 with respect to the manner in which material may be loaded therein may be a function of the increases or decreases in desired operator aggressiveness and, thus, operator interface device 16*b* may be configured to adjust the manner in which machine 10 may be operated. Additionally, operator interface 16*c* may include a joystick configured to produce a signal indicative of an operator's desire to affect manual control of implement 24, i.e., an operator's desire to cease automatic control of implement 24. Operator interface device 16*c* may be, for example, configured to control actuator 26, control the position of apron 31, and/or control additional functions indicative of an operator's desire to affect manual control of implement 24 and may or may not be indicative of a maximum amount of material 30 within bowl 14. The operation of apron 31 is well known in the art and, thus, is not further described. It is contemplated that additional and/or different operator interface devices may be included, such as, for example, multi-axis joysticks, knobs, push-pull devices, switches, keyboards, keypads, touch-screens, and/or other operator interface devices known in the art. It is also contemplated that operator interface devices 16*a*, 16*b*, 16*c* and/or the additional operator interface devices may be configured to control the operation of one or more additional components of machine 10.

Controller 18 may include one or more microprocessors, a memory, a data storage device, a communications hub, and/or other components known in the art. Specifically, controller 18 may monitor one or more parameters of machine 10 and may control the movement of bowl 14. It is contemplated that controller 18 may be integrated within a general machine control system capable of controlling additional various functions of a machine 10, e.g., a power source or a hydraulic system. Controller 18 may be configured to receive input signals from one or more sensors 32, 34 perform one or more algorithms to determine appropriate output signals, and may deliver the output signals to one or more components to control the movement of bowl 14 and the depth of cut of implement 24. Specifically, controller 18 may control one or more valves and/or other components of the hydraulic system, e.g., pumps, to selectively supply pressurized fluid toward and from actuator 26. It is contemplated that controller 18 may receive and deliver signals via one or more communication lines (not referenced) as is known in the art.

Traction devices 20 may include wheels located on either side of tractor 12 and may be configured to affect the propulsion and yaw of tractor 12, and thus machine 10, with respect to surface 22. Traction devices 20 may include one or more driven components, e.g., an axle or a sprocket, one or more non-driven components, e.g., a guide wheel or a hub, and/or additional components known in the art. The driven components may be operatively connected to a power source via any conventional arrangement including, e.g., a drive train, differential gear transfers, and/or other suitable mechanisms, to receive mechanical power therefrom and provide movement to traction devices 20. Movement of traction devices 20 may propel tractor 12 with respect to surface 22 which may, in turn, pull bowl 14 across surface 22. It is contemplated that traction devices 20 may additionally or alternately include tracks, belts, or other traction devices, may include any number of traction devices. It is also contemplated that traction devices 20 may be hydraulically controlled, mechanically controlled, electronically controlled, or controlled in any other suitable manner. It is further contemplated that traction devices 28 may be substantially similar to traction device 20 and, as such, will not further described.

Implement 24 may include any device used in separating material from surface 22. For example, implement 24 may include a blade, a ripper, and/or any other task-performing device known in the art. Implement 24 may be directly, e.g., fixed, or indirectly, e.g., movably, connected to bowl 14 via any suitable manner. Implement 24 may be configured at a predetermined and fixed position and/or configured to pivot and/or move relative to bowl 14 in any manner known in the art. Implement 24 may further be configured to penetrate surface 22 to disturb or disrupt the material thereof as a function of the position of bowl 14. For example, implement 24 may engage surface 22 to scoop, slice, tear, rake, and/or perform any other type of task known in the art. The depth of cut of implement 24, i.e., the distance below surface 22 that implement 24 penetrates, may be adjusted by the actuation of actuator 26 and may be controlled by controller 18.

Actuator 26 may include a piston-cylinder arrangement, a hydraulic motor, and/or any other known actuator having one or more fluid chambers therein. For example, actuator 26 may embody a piston-cylinder assembly (as illustrated in FIG. 1) and a hydraulic system (not shown) may selectively supply and drain pressurized fluid from one or more chambers within the cylinder to affect movement of a piston-rod assembly as is known in the art. The expansion and retraction of actuator 26 may function to affect movement of bowl 14 and, thus, implement 24 with respect to surface 22. For example, one end of actuator 26 may be connected to tractor 12 or a fixed support point of bowl 14 and another end of actuator 26 may be connected to a movable support point of bowl 14. It is contemplated that actuator 26 may be operatively connected to one or more components of machine 10 such that movement thereof may affect movement of bowl 14 and implement 24 with respect to surface 22.

The pressure of the pressurized fluid within a chamber of actuator 26 may be influenced by the amount of pressurized fluid directed toward that chamber and the amount of resistance an external load may apply against actuator movement. For example, a hydraulic system may selectively direct pressurized fluid from a source of pressurized fluid, e.g., a pump, toward one or more chambers and selectively direct pressurized fluid from one or more chambers toward a tank via one or more valves to extend and retract the piston-rod. Controlling the flow and pressure of pressurized fluid to one or more chambers, i.e., expanding and contracting chambers, arranged on opposite sides of a piston to adjust the speed and force that a piston-rod extends and retracts is well known in the art. It is also contemplated that the above discussion regarding actuator 26 embodied as a piston-cylinder arrangement is applicable if actuator embodies a hydraulic motor arrangement or any other type of actuator known in the art. It is also contemplated that actuator 26 may not be a hydraulic actuator and, as such, a non-hydraulic system, e.g., a gear train, rack and pinion system, linkage, and/or other apparatus may affect the extension and retraction of actuator 26.

Loaded material 30 may include material disrupted and/or dislodged from surface 22 and diverted into bowl 14. Specifically, bowl 14 may be lowered via actuator 26, implement 24 may engage and penetrate surface 22, and because bowl 14 may be pulled across surface 22, material therefrom may be separated by the reactive force between implement 24 and surface 22. Bowl 14 may be configured to direct and load the separated material therein. Loaded material 30 may accumulate as a function of the depth of cut of implement 24, the speed of machine 10, and/or the material characteristics. For example, loaded material 30 may accumulate faster with a deeper depth of cut, a higher speed, and softer material as compared with a shallower depth of cut, lower speed, and/or harder material, respectively. It is contemplated that loaded material may include any type of material, such as, for example, soil, aggregate, sand, clay, and/or mixtures thereof and may include any material properties, e.g., hard, soft, rocky, compacted, wet, and/or dry.

Sensors 32, 34 may include any conventional sensor configured to establish a signal as a function of a sensed physical parameter. Sensor 32 may be configured to sense the speed of traction devices 20 with respect to tractor 12. For example, sensor 32 may be disposed adjacent a driven component, e.g., an axle (not referenced), configured to apply a drive force, e.g., a torque, to traction devices 20. Alternatively, sensor 32 may be disposed adjacent any component of traction devices 20 and/or components of tractor 12 configured to impart movement to traction devices 20. Sensor 34 may be configured to sense the speed of machine 10 with respect to surface 22 and may be, for example, disposed adjacent surface 22. It is contemplated that sensors 32, 34 may each selectively include a plurality of sensors each establishing a plurality of signals and that each plurality of signals may be combinable into a common signal. It is also contemplated that sensors 32, 34 may embody any type of sensor known in the art, such as, for example, sensors 32, 34 may embody hall sensors, global positioning signals, infrared or radar speed sensors.

Figure 2:
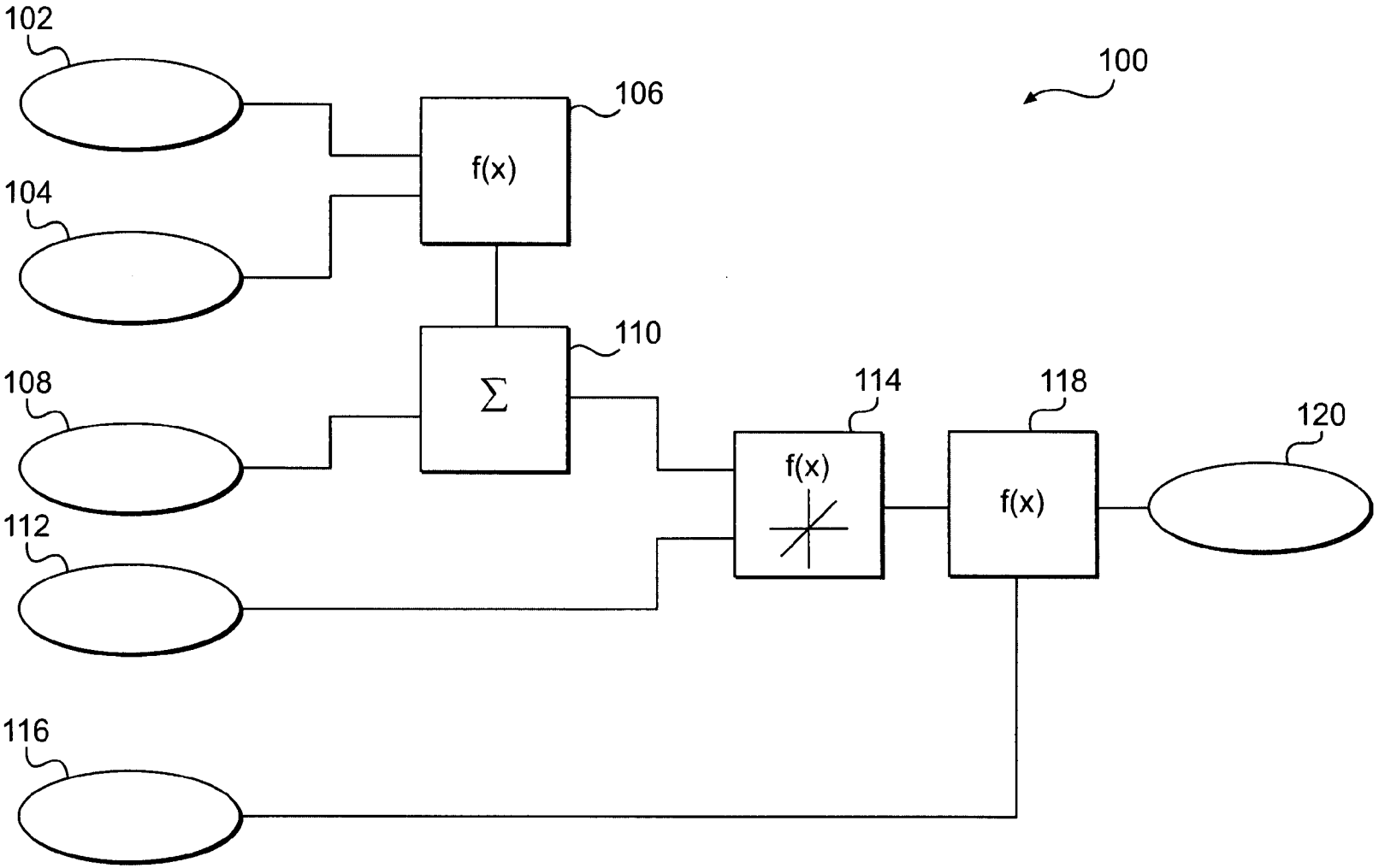
FIG. 2 is a schematic illustration of an exemplary control algorithm configured to be performed by the controller of FIG. 1.

FIG. 2 illustrates an exemplary control algorithm 100. Control algorithm 100 may be performed by controller 18 to control the depth of cut of implement 24. Specifically, control algorithm 100 may determine an output 120, as a function of one or more parameters and may include receiving a plurality of inputs, e.g., signals generated by one or more of sensors 32, 34 and/or operator interface devices 16*a*, 16*b*, 16*c*, and perform a plurality of functional relations, e.g., algorithms, equations, subroutines, look-up maps, tables, and/or comparisons, to determine output 120 and thus influence the operation of implement 24. It is contemplated that the functional relations described below may be performed in any order and are described herein with a particular order for exemplary purposes only. It is also contemplated that control algorithm 100 may be performed continuously, periodically, with or without a uniform frequency, and/or singularly.

Input 102 may include a signal indicative of a speed of traction device 20. Specifically, input 102 may be indicative of a signal produced by sensor 32 and may be representative of the speed of a driven component of traction device 20. Input 104 may include a signal indicative of a speed of machine 10. Specifically, input 104 may be indicative of a signal produced by sensor 34, which may be indicative of the speed of machine 10 relative to surface 22. It is contemplated that inputs 102, 104 may be represented in any suitable and/or desirable units, e.g., revolutions per minute, feet per second, or kilometers per hour. It is also contemplated that inputs 102, 104 may be converted into digital representations of one or more values, e.g., by converting a voltage level produced by signals 32, 34 into digital signals further manipulable within control algorithm 100.

Functional relation 106 may include functionally relating driven speed, e.g., input 102, and machine speed, e.g., input 104, to determine an amount of slip, e.g., machine slip. Slip may represent the difference between driven speed and machine speed and may be caused by, for example, traction device 20 "slipping" relative to surface 22 due to implement 24. Specifically, implement 24 may apply a force on machine 10 as a function of the friction between implement 24 and the material associated with surface 22, thus resisting movement of machine 10 as propelled by tractor 12 by countering a drive or traction force. The magnitude of slip may be influenced by the characteristics of the material and the depth of cut of implement 24, e.g., relatively low slip values may be indicative of relatively low resistance on machine 10 by implement 24. It is contemplated that zero slip may or may not be desirable and that it may be desirable to monitor and control slip within a predetermined range, e.g., as established via operator interface device 16*a*.

Functional relation 106 may, specifically, include determining slip by mathematically relating the driven speed and the machine speed. For example, functional relation 106 may embody the mathematical formula: $S_e=1-(S_m/S_d)$, wherein $S_e$ represents the machine slip, $S_m$ represents machine speed, and $S_d$ represents driven speed. It is contemplated that the determined slip may be represented as a value, a fraction of machine or driven speed, and/or a percentage.

Input 108 may include a signal indicative of a desired or target slip of machine 10. Specifically, input 108 may be representative of the signal produced by operator interface device 16*a* and may be representative of magnitude and/or degree of slip desired or suitable for the conditions of surface 22, e.g., a greater degree of slip may be desired or suitable for harder material. It is further contemplated that input 108 may be represented as a range and may be in any suitable and/or desirable units, e.g., a percentage or a dimensionless number. It is also contemplated that input 108 may be converted into digital representations of one or more values, e.g., by converting a voltage level produced by operator interface device 16*a* into digital signals further manipulable within control algorithm 100.

Functional relation 110 may include functionally relating the actual slip value, as determined within functional relation 106, and the slip target, e.g., input 108, to determine a slip error value. Specifically, functional relation 110 may establish the slip error value by functionally combining the machine slip with the desired slip by, for example, subtracting input 108 from functional relation 106. As such, the slip error value may be configured to affect the position and/or movement of implement 24 to achieve or progress toward a desired amount of machine slip. The magnitude of the error may be indicative of the degree of difference between the machine slip and the desired slip and may be influenced by the characteristics of the material and the depth of cut of implement 24, e.g., relatively low slip values may be indicative of relatively low resistance on machine 10 by implement 24. It is contemplated that zero slip may or may not be desirable and that it may be desirable to monitor and control the slip value within a predetermine range.

Input 112 may include a signal indicative of an operator's desire to cease automatic control of implement 24, e.g., cease operation of control algorithm 100. Specifically, input 112 may be indicative of a signal produced by operator interface device 16*c*, which may, for example, control the operation of actuator 26, apron 31, and/or other function. It is contemplated that input 112 may or may not be indicative of a maximum amount of material 30 within bowl 14. It is also contemplated that input 112 may be represented in any suitable and/or desirable units, e.g., voltage, and may be converted into digital representations thereof further manipulable within control algorithm 100.

Functional relation 114 may include functionally relating the slip error and the operator's desire to cease automatic control to determine a command value. Specifically, functional relation 114 may establish the command value by interrelating the slip error, as determined within functional relation 110 to determine if the slip is within respective predetermined ranges of acceptable values indicative of desired maximum and minimum slip. For example, functional relation 114 may determine that the slip error is less than a minimum slip error value and may correspondingly establish a parameter to influence operation of machine 10, e.g., a lowering of implement 24 deeper below surface 22, to thereby increase the amount of slip. Conversely, functional relation 114 may determine that the slip error is greater than a maximum slip error value and may correspondingly establish a parameter to influence operation of machine 10, e.g., a raising of implement 24 shallower below surface 22, to thereby decrease the amount of slip. Additionally, functional relation 114 may determine that an operator desires to cease automatic control of implement 24 as a function of input 112 and may establish a parameter to influence operation of machine 10, e.g., raise input 24 out of engagement with surface 22. Specifically, any change in signal from input 112 may be indicative of the operator's desire to affect manual control of implement 24 and/or machine 10. Conversely, functional relation 114 may determine that an operator does not desire to affect manual control of implement 24 and/or machine 10 as a function of input 112 and may establish a parameter to have a non-influencing effect on the operation of machine 10, e.g., maintaining the depth of cut of implement 24.

Functional relation 114 may further include functionally relating the parameters associated with the slip error and whether an operator desires to affect manual control of implement 24 to establish the command signal via, for example, one or more multi-dimensional look-up maps and/or one or more equations. For example, functional relation 114 may include determining which of the respective parameters would influence the operation of implement 24 to a shallower or deeper depth of cut with respect to surface 22, relating the parameters according to a predetermined priority or hierarchy, relating percentages of each of the parameters, and/or relating one or more of the parameters via any suitable method to establish the command signal. It is contemplated that the relationships of the determined parameters may be determined by test data, experimentation, extrapolation, analytically, and/or by any other method known in the art. It is further contemplated that functional relation 114 may, alternatively further include a time component in which algorithm 100 may abort after a predetermined amount of time has elapsed. The predetermined elapse time may be a function of machine specific loading characteristics along with material characteristics to effectively end automatic operation and automatically raise the bowl and cease engagement of implement 24 with surface 22. It is contemplated that the time component may be adjustable and/or setable by an additional operator interface device (not shown) in which the operator may set to a position to allow control algorithm 100 to operate for a period of time, depending on the loading conditions, in which the bowl becomes full, and algorithm 100 automatically ceases to operate and prepares other machine functions for transportation of loaded material 30. It is contemplated that the input 112 indicative of an operator's desire with respect to manual control of implement 24 may be configured to override the parameter associated with the slip error.

Input 116 may include a signal indicative of the desired aggressiveness for operation of machine 10. Specifically, input 116 may be indicative of a degree and/or magnitude of a displacement of operator interface 16*b* and may be representative of the desired aggressiveness of the control of implement 24. It is contemplated that input 116 may be represented in any suitable and/or desirable units, e.g., a dimensionless factor, a percentage, and/or a numerical value between 0 and 1. It is also contemplated that input 116 may be represented in any suitable and/or desirable units, e.g., voltage, and may be converted into digital representations thereof further manipulable within control algorithm 100.

Functional relation 118 may include functionally relating the command signal, e.g., as determined within functional relation 114, and the desired aggressiveness, e.g., input 116, to determine a combined command. For example, functional relation 118 may include multiplying the command signal by the desired aggressiveness. As such, functional relation 118 may be configured to scale the command signal with respect to an operator's desired operation of machine 10. It is contemplated that the desired aggressiveness may be configured to have any desired modifying effect on the command signal. For example, if input 116 is between 0 and 1, a value of 0.5 may have zero or a neutral affect on the command signal or may reduce the command signal by approximately half. For another example, if input 116 is between 0 and 1, a value of 1 may have a zero or neutral effect on the command signal or may increase the command signal by a predetermined factor. It is also contemplated that functional relation 118 may or may not functionally relate the command signal and the desired aggressiveness linearly and may include any suitable mathematical or functional equation known in the art.

Output 120 may include an output command indicative of the combined command, e.g., as determined within functional relation 116, and may be configured to be communicated by controller 18 to a hydraulic system and, in particular, to one or more valves, operatively connected to actuator 26 to affect the flow of pressurized fluid to and from actuator 26. For example, output 120 may include a voltage configured to operate a solenoid valve to proportionally or non-proportionally affect movement of a valve stem between a substantially closed position and a fully opened position, as is known in the art. It is contemplated that output 120 may embody any type of signal, such as, for example, an analog or digital signal, a wave, light, or electronic signal, and/or any type of signal known in the art configured to affect the position and/or movement of implement 24. It is also contemplated that output 120 may be configured as an input to one or more other control algorithms configured to affect operation of the hydraulic system, implement 24, and/or machine 10.

INDUSTRIAL APPLICABILITY

The disclosed system for automatically loading a scraper bowl may be applicable to any material handling machine configured to load, contain, transport, and unload material. The disclosed system may provide a more accurate loading of bowl 14. The operation of method 10 is explained below.

Machine 10 may be operated to traverse surface 22, e.g., a work site, to dislodge or disrupt material therefrom, load material into bowl 14, and transport loaded material 30 to another location for unloading. As such, surface 22 may be manipulated to achieve a desired grade and/or material may be moved from surface 22 to achieve a desired grade at the unloading location.

Referring to FIG. 1, tractor 12 may be operated by an operator to pull bowl 14 across surface 22. The operator may or may not initiate operation of bowl 14 and implement 24 via one or more manual operations and controller 18. Regardless, controller 18 may perform control algorithm 100 to affect control of bowl 14 and implement 24 as the operator drives tractor 12. The material of surface 22 may have varying characteristics and implement 24 may, for example, transition from hard material to relatively soft material and/or from clay to dry soil. As such, controller 18 may receive one or more inputs indicative of sensed operating parameters via sensors 32, 34 and operator inputs via operator interface devices 16*a*, 16*b*, 16*c* to affect movement of bowl 14 and thus implement 24 in response thereto.

Referring to FIG. 2, control algorithm 100 may receive inputs from sensors 32, 34 and operator interface devices 16*a*, 16*b*, 16*c* representing the speed of traction devices 20, the speed of machine 10 with respect to surface 22, the desired slip of machine 10, a signal indicative of an operator's desire to affect manual control, and the desired aggressiveness of the operation of machine 10, e.g., inputs 102, 104, 108, 112, 116. Control algorithm may perform one or more functional relations, e.g., functional relations 106, 110, 114, 118, to determine a command signal and establish output 120. It is contemplated that if control algorithm 100 is repeated according to a frequency, output 120 may be dynamically established and thus bowl 14 and implement 24 may be dynamically controlled.

For example, if implement 24 transitions from soft to hard material, the slip, as determined within functional relation 106, and the slip error, as determined within functional relation 110, may both increase. As such, output 120 may be established to raise implement 24 to a shallower depth of cut with respect to surface 22. Conversely, if implement 24 transitions from hard to soft material, the slip and slip error may both decrease and output 120 may be established to lower implement 24 deeper with respect to surface 22. Additionally, as the amount of loaded material 30 increases as machine 10 traverses surface 22 and implement 24 engages and/or penetrates surface 22, accumulation of loaded material 30 may exceed a maximum desired amount of loaded material 30. It is contemplated that if loaded material 30 exceeds the maximum desired amount of loaded material 30, input 112 may be configured to affect control of implement 24 to not engage surface 22 regardless of the determined slip and/or slip error. It is also contemplated that input 116, e.g., the desired aggressiveness, may be dynamically adjusted and thus may dynamically affect output 120 as the desired operation of machine 10 changes.

Because control algorithm 100 determines and interrelates slip error, desired aggressiveness, and monitors when an operator may desire manual control, the accuracy in control of bowl 14 and implement 24 as affected by changing material characteristics and terrain may be increased.

It will be apparent to those skilled in the art that various modifications and variations can be made to the disclosed system for automatically loading a scraper. Other embodiments will be apparent to those skilled in the art from consideration of the specification and practice of the disclosed method and apparatus. It is intended that the specification and examples be considered as exemplary only, with a true scope being indicated by the following claims and their equivalents.

What is claimed is:

1. A method for controlling an implement operatively connected to a machine having at least one traction device comprising:

receiving a first signal indicative of a speed of a driven component of the at least one traction device;

receiving a second signal indicative of a speed of the machine with respect to a surface;

receiving a third signal indicative of a desired slip of the machine with respect to the surface;

selectively receiving a fourth signal indicative of an operator's desire to affect manual control of the implement;

determining a first parameter as a function of the received first, second, third, and selectively received fourth signals; and controlling the implement as a function of the first parameter.

2. The method of claim 1, further including:

receiving a fifth signal indicative of a desired operation of the machine; and controlling the implement as a function of the first parameter and the fifth signal.

3. The method of claim 2, wherein the fifth signal is a percentage value and the method further includes:

determining a second parameter by multiplying the first parameter and the percentage value; and controlling the implement as a function of the second parameter.

4. The method of claim 1, wherein:

an actuator affects movement of the implement with respect to the surface; and controlling the implement includes affecting movement of the actuator.

5. The method of claim 1, wherein:

the fourth signal is indicative of an operator command.

6. The method of claim 1, further including determining a second parameter indicative of the amount of traction slip the machine experiences with respect to the at least one traction device and the surface as a function of the first and second signals.

7. The method of claim 6, further including determining the first parameter as a function of the second parameter.

8. The method of claim 1, wherein:

determining the first parameter includes comparing the fourth signal with a predetermined value; and controlling the implement to not engage the surface when the fourth signal exceeds the predetermined value regardless of the first, second, and third signals.

9. A system for controlling an implement operatively associated with a scraper bowl configured to contain material separated from a surface of material by the implement, comprising:

an actuator configured to affect movement of the implement with respect to the surface of material;

a first operator interface device configured to establish a parameter indicative of an operator's desire to affect manual control of the implement;

a plurality of sensors; and a controller configured to:

selectively receive a first signal indicative of an actuation of the first operator interface device and receive a plurality of signals from the plurality of sensors, determine an amount of slip associated with the scraper bowl with respect to the surface of the material as a function of the plurality of signals, determine a first parameter as a function of at least the first signal and the determined amount of slip, and affect control of the actuator as a function of the determined first parameter.

10. The system of claim 9, wherein the first parameter is configured to affect control of the implement to not engage the surface of the material when the value of the first signal is greater than a predetermined value.

11. The system of claim 9, wherein the first operator interface device is configured to affect movement of the actuator.

12. The system of claim 9, wherein the first operator interface device is configured to affect movement of an apron operatively associated with the scraper bowl.

13. The system of claim 9, wherein the controller is further configured to receive a second signal indicative of an actuation of a second operator interface device, the second operator interface device configured to allow an operator to adjust the operation of the scraper.

14. The system of claim 13, wherein the controller is further configured to:

determine a second parameter as a function of the first parameter and the second signal; and affect movement of the actuator as a function of the second parameter.

* * * * *